US008317125B2

(12) United States Patent
Lindley et al.

(10) Patent No.: US 8,317,125 B2
(45) Date of Patent: Nov. 27, 2012

(54) STRAP SPOOL MOUNTABLE TO A SHAFT

(76) Inventors: Dallis A. Lindley, Granger, IN (US); Timothy S. Klusczinski, Elkhart, IN (US)

( * ) Notice: Subject to any disclaimer, the term of this patent is extended or adjusted under 35 U.S.C. 154(b) by 311 days.

(21) Appl. No.: 12/798,323

(22) Filed: Apr. 1, 2010

(65) Prior Publication Data

US 2011/0240791 A1 Oct. 6, 2011

(51) Int. Cl.
*B65H 75/00* (2006.01)
*B65H 75/28* (2006.01)

(52) U.S. Cl. ..... 242/608.4; 242/587.3; 242/609.2

(58) Field of Classification Search ..... 242/407, 242/407.1, 579, 582, 587–587.3, 600, 607, 242/607.1, 608, 608.2–608.8, 609–609.4
See application file for complete search history.

(56) References Cited

U.S. PATENT DOCUMENTS 3,173,536 A * 3/1965 Gittler et al. ..... 206/408
4,867,391 A * 9/1989 Resch ..... 242/118.5
6,732,966 B2 * 5/2004 Wier ..... 242/376

* cited by examiner

*Primary Examiner* — William E Dondero
(74) *Attorney, Agent, or Firm* — R. Tracy Crump

(57) ABSTRACT

The strap spool is mountable to drive shafts in various strap winding apparatus, such as winches and torsion spring counterbalances. The strap spool has a two piece design where two symmetrical spool halves slidably mate to form a drum around which the strap is wound. Each spool half has a central hub with an axial opening, which allows the spool halves to mount onto a drive shaft. An annular flange extending radially around the hub and a barrel sleeve extends from the hub perpendicular to the flange. When spool halves are mated together on a drive shaft, the barrel sleeves slidably extend into axial openings in the hub of the opposite spool half and form a tubular drum overlying the drive shaft around which the strap is wound.

28 Claims, 6 Drawing Sheets

STRAP SPOOL MOUNTABLE TO A SHAFT

This invention relates to strap spools mountable to drive shafts in various strap winding apparatus, such as winches and torsion spring counterbalances.

BACKGROUND AND SUMMARY OF THE INVENTION

Nylon webbing has begun to replace wire cable in a variety of mechanical winding apparatus. For example, certain winches, ramp door lifts, and over head door torsion spring counterbalances have been developed that use lengths of nylon webbing in place of wire cable. While webbing is replacing the traditional wire cable, conventional winding apparatus still wind the lengths of webbing onto single-piece cast or molded drums as with the wire cable.

The strap spool of this invention has a two piece design where two symmetrical spool halves slidably mate to form a drum around which the strap is wound. Each spool half has a central hub with an axial opening, which allows the spool halves to mount onto a drive shaft. An annular flange extending radially around the hub and a barrel sleeve extending from the hub perpendicular to the flange. When spool halves are mated together on a drive shaft, the barrel sleeves slidably extend into axial openings in the hub of the opposite spool half and form a tubular drum overlying the drive shaft around which the strap is wound. The strap spool's two piece design and the slidable engagement of the two mating spool halves allows the strap spool to accommodate straps of various widths. The two-piece design also enables convenient strap installation and replacement without additional fasteners, ties or tools.

Theses and other advantages of the present invention will become apparent from the following description of an embodiment of the invention with reference to the accompanying drawings.

BRIEF DESCRIPTION OF THE DRAWINGS

The drawings illustrate an embodiment of the present invention, in which.

DESCRIPTION OF THE PREFERRED EMBODIMENT

Figure 1:
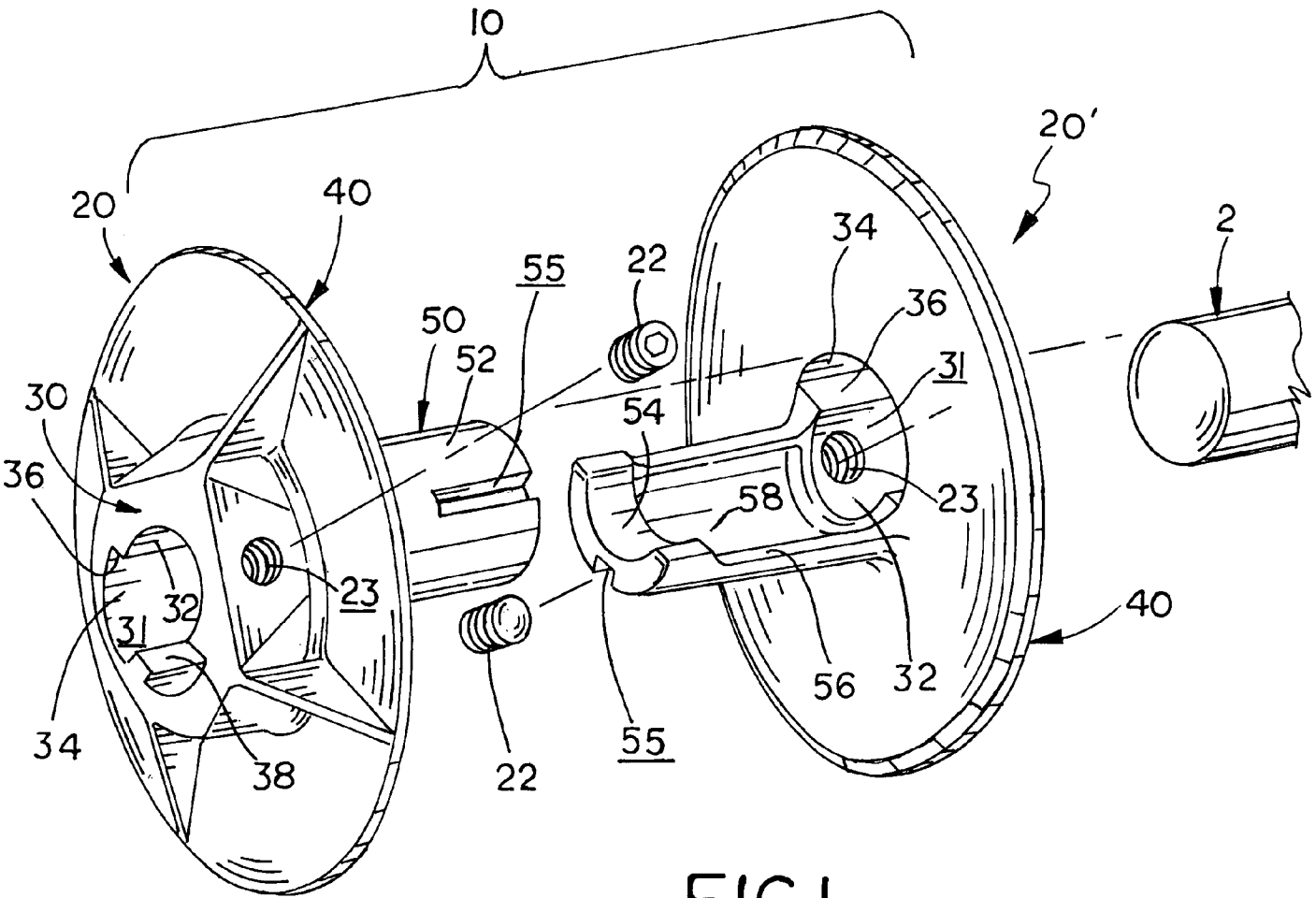
FIG. 1 is an exploded perspective view of an embodiment of the strap spool of this invention.

Referring now to the drawings, FIGS. 1-6 illustrate an embodiment of the strap spool of this invention, designated generally as reference number 10. Spool 10 is designed primarily for use with a winding strap but may be modified within the teachings of this invention for use winding cable and cord. Spool 10 incorporates a two-piece design with two symmetrical spool halves 20 and 20' slidably mated together to form a drum around which the strap is wound. The slidable engagement of the two mating spool halves allows the strap spool to accommodate straps of various widths. Ideally, the spool halves are molded from polymer plastics, but may be cast or molded from suitable metals and alloys or otherwise constructed for use in the intended application or winding apparatus. The size and dimensions of the spool may vary with the intended strap winding apparatus or application within the teachings of this invention.

As shown, each half 20 and 20' has a central hub 30, an integral annular flange 40 extending radially around the hub, and an integral barrel sleeve 50 extending axially from the hub perpendicular to the flange. Hubs 30 have an axial opening 31, which allows the spool halves 20 and 20' to mount onto a drive shaft. When halves 20 and 20' are mated together on a drive shaft (FIGS. 2 and 3), barrel sleeves 50 slidably extend into axial openings 31 in the mating hub 30 and form a tubular drum overlying drive shaft 2 around which strap 4 is wound. Set screws 22 or similar fasteners turned into threaded bores 23 in hub 30 hold halves 20 and 20' to drive shaft 2.

As shown, barrel sleeves 50 have a convex outer surface 52 and a concave inner surface 54. Openings 31 of each hub 30 are defined in part by a first arcuate inner sidewall 32 and a second inner sidewall 34. The radius of second inner wall 34 is greater than the radius of first inner wall 32, thereby defining a recessed axial channel within which the distal ends of barrel sleeve 50 of the mating spool half 20 and 20' nests. When mated together, the convex outer surface 52 of barrel sleeve 50 seats against second inner sidewall 34 of hubs 30. In addition, concave inner surface 54 of barrel sleeves 50 share the same inner radius as first inner sidewall 32 of hubs 30 to form the axial bore for receiving drive shaft 2. When mated together, the sides 56 of barrel sleeves 50 abut the flat edges 36 between first inner sidewall 32 and second inner sidewall 34 to prevent the halves from rotating with respect to one another. In addition, barrel sleeve 50 has a longitudinal groove 55 for receiving a raised axial rib 38, which extends radially from second inner wall 34, which further prevents the halves from rotating but also serves as a limit to the axial travel of the halves relative to each other (the axial travel is arrested when rib 38 abuts the end of groove 55).

FIGS. 1-6 illustrate the installation of spool 10 onto a conventional drive shaft 2 of a typical torsion spring counterbalance, the type used in over head and ramp door applications. While the drive shaft is illustrated as part of a counterbalance apparatus, it should be understood that strap spool 10 can be mounted to any cylindrical shaft in any winding apparatus or application. Installation begins with one spool half 20' being slid onto the end of drive shaft 2 with barrel sleeve 50 pointing outward. Once first spool half 20 is secured to drive shaft 2 by set screw 28, strap 4 is seated around drive shaft 2 and under barrel sleeve 50. With strap 4 in place under barrel sleeve 50 of the first spool half 20, the second spool half 20' is mounted to drive shaft 2 so that its barrel sleeves 50 mate with hub 30 of the first spool half 20 and strap 4 is interposed between the barrel sleeves and drive shaft 2. Barrel sleeves 50 also have a recessed edge 56 and inner wall section 58 which is spaced from drive shaft to create a gap and passage through which strap 4 passes interposed between drive shaft 2 and barrel sleeves 50.

Figure 2:
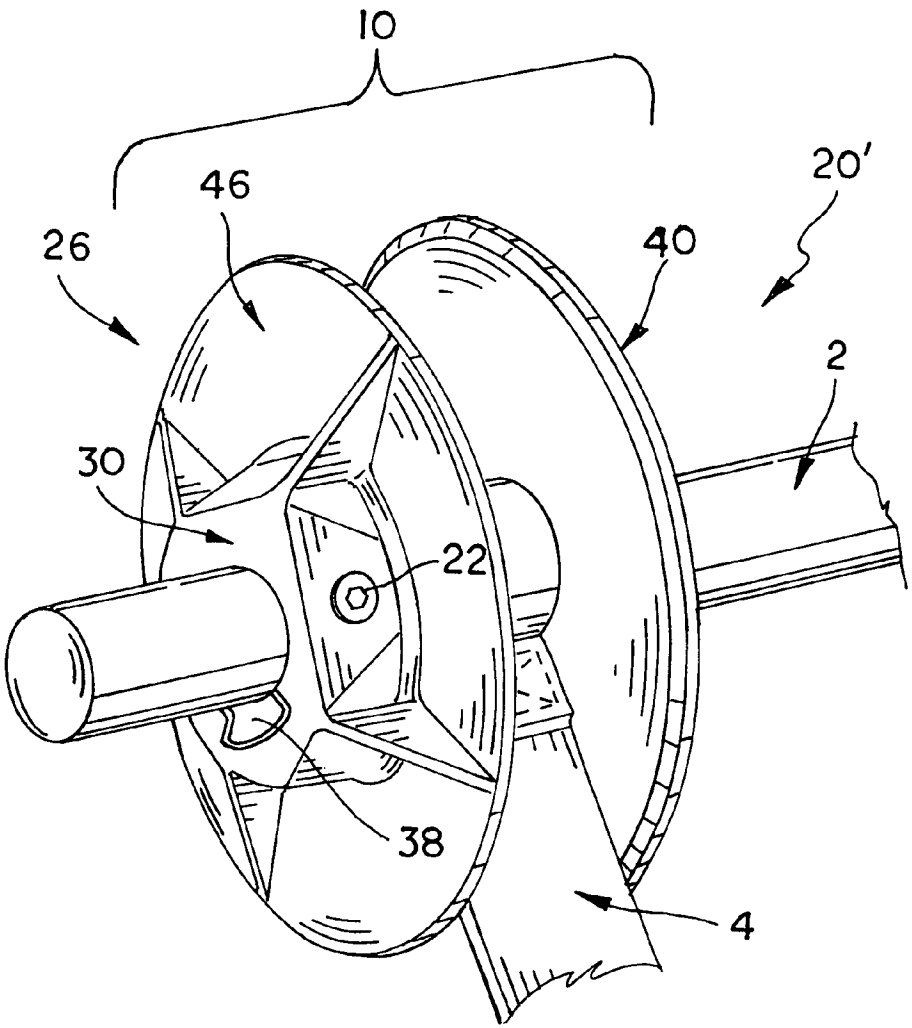
FIG. 2 is another exploded perspective view of the strap spool of FIG. 1 partially mounted to a drive shaft of a simple torsion spring counterbalance with a strap having a looped end fitted to the shaft.
Figure 3:
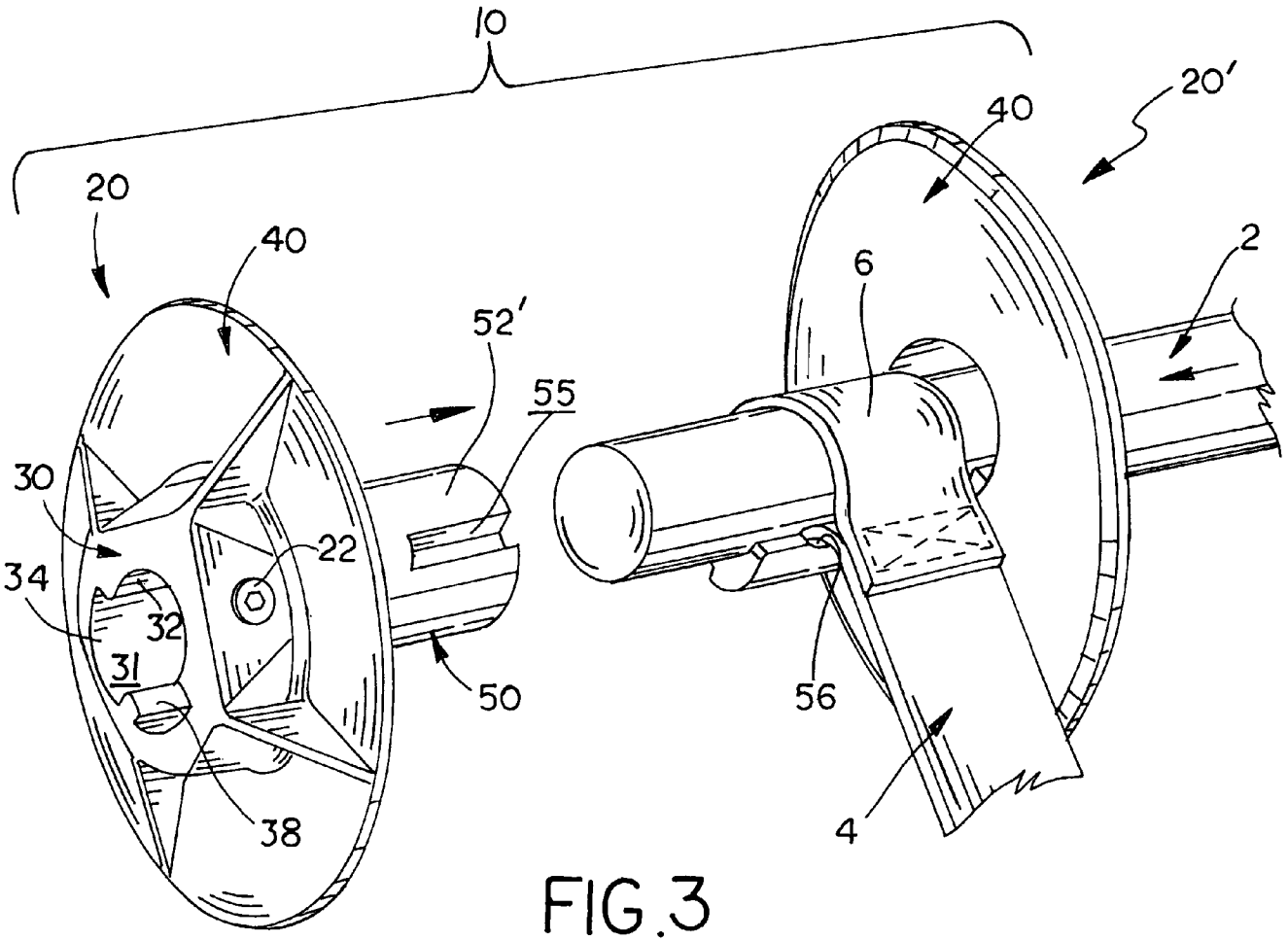
FIG. 3 is a perspective view of the strap spool of FIG. 1 mounted to a drive shaft and the strap connected to the spool.
Figure 4:
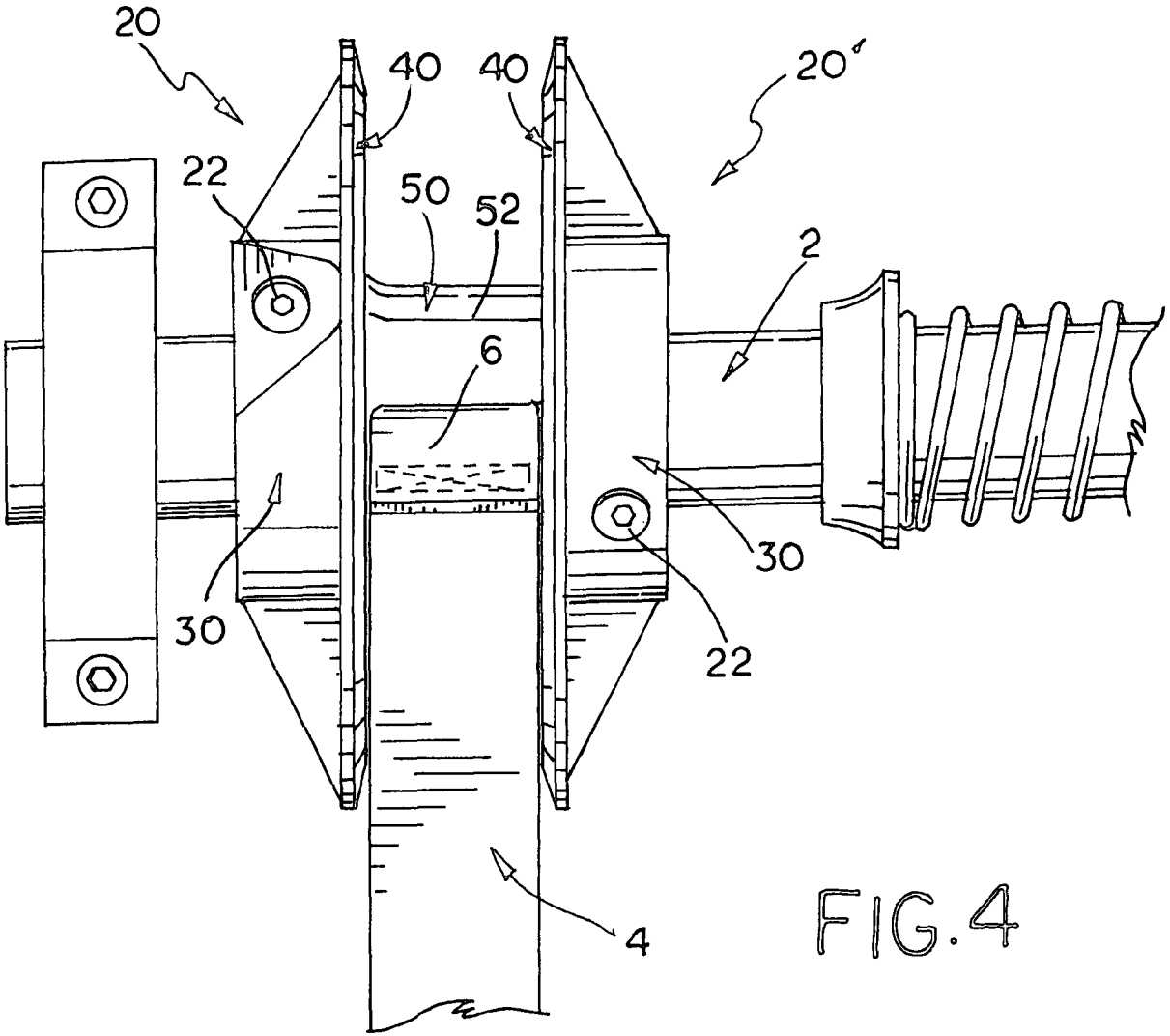
FIG. 4 is a top view of the strap spool of FIG. 1 mounted to the drive shaft of a torsion spring counterbalance and the strap connected to the spool.
Figure 5:
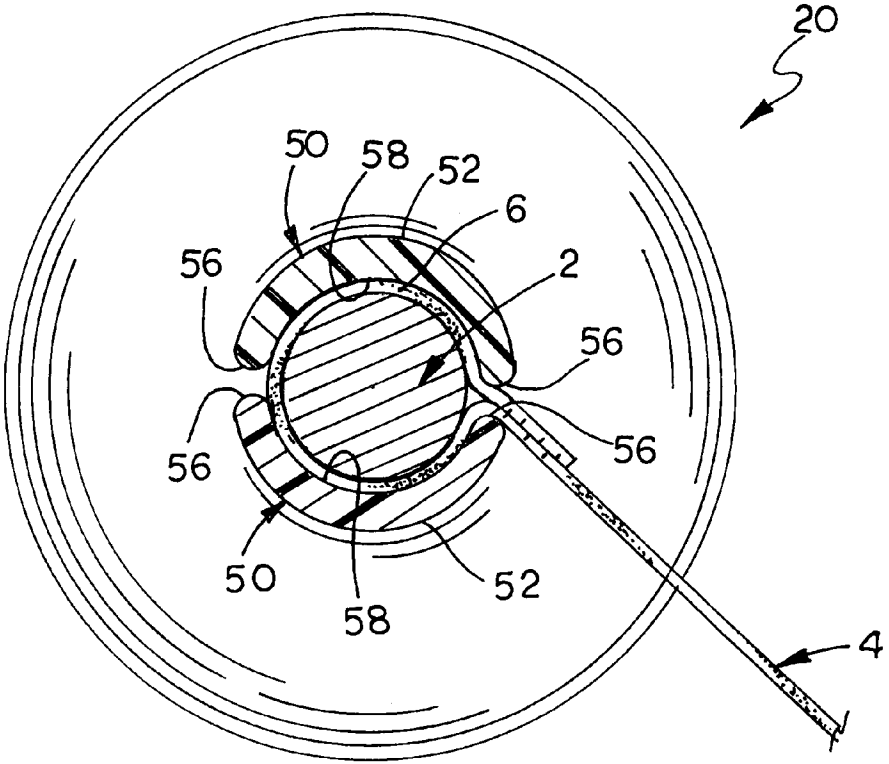
FIG. 5 is a side sectional view of the strap spool and drive shaft of FIG. 1 and a strap having a looped end.
Figure 6:
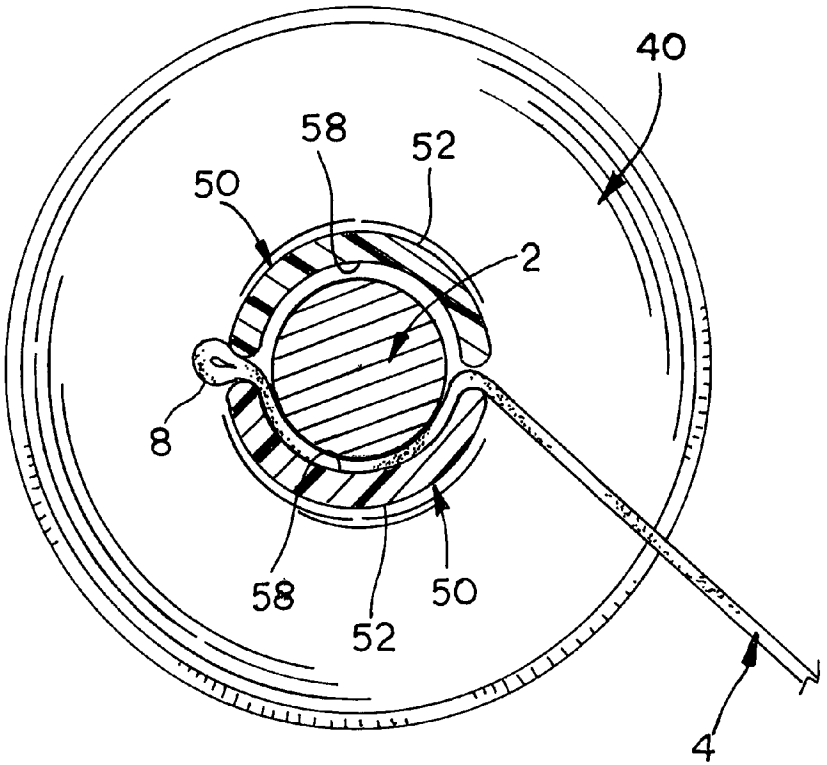
FIG. 6 is a side sectional view of the strap spool and drive shaft of FIG. 1 and a strap having an end stop.

To facilitate the connection of strap 4 to strap spool 10, strap 4 may terminate in a looped end 6 (FIGS. 2-5) or with an end stop 8 (FIG. 6). Stop block 8 may be formed by the sewn overlapping of the strap end or by affixing some obstructing block or wedge to the end strap. Looped end 6 of strap 4 is simply slid over drive shaft 2 and under barrel sleeve 50 of both spool halves 20 and 20' (FIG. 2). Alternatively, strap 4 is simply trained between barrel sleeve 50 of one spool half 20 and drive shaft 2 with the stop end abutting the gap between the adjacent barrel sleeves. Because end stop 8 is unable to pull through the gap between barrel sleeves 50, strap 4 is securely connected to strap spool 10 for winding.

ADVANTAGES

One skilled in the art will note that the strap spool of this invention provides several advantages over conventional single-piece cable and strap drums. The strap spool's two piece design allows the width of the strap drum area to be set by the axially positioning of the two mating spool halves, thereby allowing the strap spool to accommodate straps of varying widths. This adjustment to the drum area width is limited only by the width of the hubs and the length of the groove in the barrel sleeve. The strap spool of this invention can be dimensioned and configured to work with any diameter of drive shaft, as well as for use with any ranges of strap widths. The two-piece design enables conveniently strap installation and replacement without additional fasteners, ties or tools. The configuration of the barrel sleeve having the gap and passage through which the strap is received between the drive shaft and barrel sleeve provides a sure connection between the strap and the strap spool. Replacement of a looped end strap can be accomplished by simply removing the outside spool half. Because each spool half is separately secured to the drive shaft, the inside spool half can remain fixed to the drive shaft while the outside spool half is pulled from the drive shaft and a new looped end strap placed around the drive shaft. In the case of straps using blocked ends, replacement of a strap can be accomplished without physically removing either spool half.

The embodiment of the present invention herein described and illustrated is not intended to be exhaustive or to limit the invention to the precise form disclosed. It is presented to explain the invention so that others skilled in the art might utilize its teachings. The embodiment of the present invention may be modified within the scope of the following claims.

We claim:

1. A strap spool mountable to a shaft for winding a strap thereon, the spool comprising:

first and second identical mating spool halves, each of the first and second spool halves includes a hub, a flange extending radially from the hub and a barrel sleeve extending from the hub perpendicular to the flange, the hub of the first and second spool halves having a hub opening for axially receiving the shaft therethrough, the barrel sleeve of each of the first and second spool halves having a distal end slide axially into the hub opening of the other of the first and second spool halves when the first and second spool halves are mated together, whereby the barrel sleeve of each of the first and second spools form a drum part around which the strap is wound, each of the first and second spool halves includes means for independently securing the one of the first and second spool halves to the drive shaft.

2. The spool of claim 1 wherein the barrel sleeve of each of the first and second spool halves overlay the shaft when the first and second spool halves are mated together and the spool is mounted to the shaft.

3. The spool of claim 1 wherein the barrel sleeve of each of the first and second spool halves has a convex outer surface and a concave inner surface.

4. The spool of claim 1 wherein the hub opening of each of the first and second spool halves is defined in part by a first arcuate inner sidewall and a second inner sidewall where the second inner sidewall has a radius greater than the radius of the first inner wall.

5. The spool of claim 4 wherein the barrel sleeve distal end of each of the first and second spool halves seats against the second inner sidewall of the hub of the other of the first and second spool halve when the first and second spool halves are mated together.

6. The spool of claim 1 wherein the hub of each of the first and second halves includes a rib extending radially into the hub opening, the barrel sleeve of each of the first and second spool halves has a longitudinal groove for slidably receiving the rib when the first and second spool halves are mated together, thereby preventing the first and second spool halves from rotating axially relative to each other.

7. The spool of claim 1 wherein the barrel sleeve of each of the first and second spool halves has a recessed inner wall section, which is spaced from the shaft when each of the first and second spool halves are mounted to the shaft, thereby creating a passage within which the strap is interposed.

8. A strap spool mountable to a shaft for winding a strap thereon, the spool comprising:

first and second identical mating spool halves, each of the first and second spool halves includes a hub, a flange extending radially from the hub and a barrel sleeve extending from the hub perpendicular to the flange, the hub of each of the first and second spool halves having a hub opening for axially receiving the shaft therethrough defined in part by a first arcuate inner sidewall and a second inner sidewall where the second inner sidewall has a radius greater than the radius of the first inner wall, the barrel sleeve of each of the first and second spool halves having a distal end slide axially into the hub opening of the other of the first and second spool halves when the first and second spool halves are mated together, whereby the barrel sleeve of each of the first and second spools form a drum part around which the strap is wound and overlay the shaft when the first and second spool halves are mated together and the spool is mounted to the shaft, the barrel sleeve distal end of each of the first and second spool halves seats against the second inner sidewall of the hub of the other of the first and second spool halves when the first and second spool halves are mated together, each of the first and second spool halves includes means for independently securing the one of the first and second spool halves to the drive shaft.

9. The spool of claim 8 wherein the hub of each of the first and second halves includes a rib extending radially into the hub opening, the barrel sleeve of each of the first and second spool halves has a longitudinal groove for slidably receiving the rib when the first and second spool halves are mated together, thereby preventing the first and second spool halves from rotating axially relative to each other.

10. The spool of claim 8 wherein the barrel sleeve of each of the first and second spool halves has a recessed inner wall section, which is spaced from the shaft when each of the first and second spool halves are mounted to the shaft, thereby creating a passage within which the strap is interposed.

11. A strap spool mountable to a shaft for winding a strap thereon, the spool comprising:

first and second identical mating spool halves, each of the first and second spool halves includes a hub, a flange extending radially from the hub and a barrel sleeve extending from the hub perpendicular to the flange, the hub having a hub opening for axially receiving the shaft therethrough, the barrel sleeve of each of the first and second spool halves having a distal end slide axially into the hub opening of the other of the first and second spool halves when the first and second spool halves are mated together, whereby the barrel sleeve of each of the first and second spools form a drum part around which the strap is wound and overlay the shaft when the first and second spool halves are mated together and the spool is mounted to the shaft, the barrel sleeve of each of the first and second spool halves has a recessed inner wall section, which is spaced from the shaft when each of the first and second spool halves are mounted to the shaft, thereby creating a passage within which the strap is interposed, each of the first and second spool halves includes means for independently securing the one of the first and second spool halves to the drive shaft.

12. The spool of claim 11 wherein the hub opening of each of the first and second spool halves is defined in part by a first arcuate inner sidewall and a second inner sidewall where the second inner sidewall has a radius greater than the radius of the first inner wall.

13. The spool of claim 12 wherein the barrel sleeve distal end of each of the first and second spool halves seats against the second inner sidewall of the hub of the other of the first and second spool halves when the first and second spool halves are mated together.

14. The spool of claim 11 wherein the hub of each of the first and second halves includes a rib extending radially into the hub opening, the barrel sleeve of each of the first and second spool halves has a longitudinal groove for slidably receiving the rib when the first and second spool halves are mated together, thereby preventing the first and second spool halves from rotating axially relative to each other.

15. A strap spool mountable to a shaft for winding a strap thereon, the spool comprising:

first and second identical mating spool halves, each of the first and second spool halves includes a hub, a flange extending radially from the hub and a barrel sleeve extending from the hub perpendicular to the flange, the hub having a hub opening for axially receiving the shaft therethrough, the barrel sleeve of each of the first and second spool halves having a distal end slide axially into the hub opening of the other of the first and second spool halves when the first and second spool halves are mated together, whereby the barrel sleeve of each of the first and second spools form a drum part around which the strap is wound, the hub of each of the first and second halves includes a rib extending radially into the hub opening, the barrel sleeve of each of the first and second spool halves has a longitudinal groove for slidably receiving the rib when the first and second spool halves are mated together, thereby preventing the first and second spool halves from rotating axially relative to each other.

16. The spool of claim 15 wherein the barrel sleeve of each of the first and second spool halves overlay the shaft when the first and second spool halves are mated together and the spool is mounted to the shaft.

17. The spool of claim 15 wherein each of the first and second spool halves includes means for independently securing the one of the first and second spool halves to the drive shaft.

18. The spool of claim 15 wherein the barrel sleeve of each of the first and second spool halves has a convex outer surface and a concave inner surface.

19. The spool of claim 15 wherein the hub opening of each of the first and second spool halves is defined in part by a first arcuate inner sidewall and a second inner sidewall where the second inner sidewall has a radius greater than the radius of the first inner wall.

20. The spool of claim 19 wherein the barrel sleeve distal end of each of the first and second spool halves seats against the second inner sidewall of the hub of the other of the first and second spool halves when the first and second spool halves are mated together.

21. The spool of claim 15 wherein the barrel sleeve of each of the first and second spool halves has a recessed inner wall section, which is spaced from the shaft when each of the first and second spool halves are mounted to the shaft, thereby creating a passage within which the strap is interposed.

22. A strap spool mountable to a shaft for winding a strap thereon, the spool comprising:

first and second identical mating spool halves, each of the first and second spool halves includes a hub, a flange extending radially from the hub and a barrel sleeve extending from the hub perpendicular to the flange, the hub of each of the first and second spool halves having a hub opening for axially receiving the shaft therethrough defined in part by a first arcuate inner sidewall and a second inner sidewall where the second inner sidewall has a radius greater than the radius of the first inner wall, the barrel sleeve of each of the first and second spool halves having a distal end slide axially into the hub opening of the other of the first and second spool halves when the first and second spool halves are mated together, whereby the barrel sleeve of each of the first and second spools form a drum part around which the strap is wound and overlay the shaft when the first and second spool halves are mated together and the spool is mounted to the shaft, the barrel sleeve distal end of each of the first and second spool halves seats against the second inner sidewall of the hub of the other of the first and second spool halve when the first and second spool halves are mated together, the hub of each of the first and second halves includes a rib extending radially into the hub opening, the barrel sleeve of each of the first and second spool halves has a longitudinal groove for slidably receiving the rib when the first and second spool halves are mated together, thereby preventing the first and second spool halves from rotating axially relative to each other.

23. The spool of claim 22 wherein each of the first and second spool halves includes means for independently securing the one of the first and second spool halves to the drive shaft.

24. The spool of claim 22 wherein the barrel sleeve of each of the first and second spool halves has a recessed inner wall section, which is spaced from the shaft when each of the first and second spool halves are mounted to the shaft, thereby creating a passage within which the strap is interposed.

25. A strap spool mountable to a shaft for winding a strap thereon, the spool comprising:

first and second identical mating spool halves, each of the first and second spool halves includes a hub, a flange extending radially from the hub and a barrel sleeve extending from the hub perpendicular to the flange, the hub having a hub opening for axially receiving the shaft therethrough, the barrel sleeve of each of the first and second spool halves having a distal end slide axially into the hub opening of the other of the first and second spool halves when the first and second spool halves are mated together, whereby the barrel sleeve of each of the first and second spools form a drum part around which the strap is wound and overlay the shaft when the first and second spool halves are mated together and the spool is mounted to the shaft, the barrel sleeve of each of the first and second spool halves has a recessed inner wall section, which is spaced from the shaft when each of the first and second spool halves are mounted to the shaft, thereby creating a passage within which the strap is interposed, the hub of each of the first and second halves includes a rib extending radially into the hub opening, the barrel sleeve of each of the first and second spool halves has a longitudinal groove for slidably receiving the rib when the first and second spool halves are mated together, thereby preventing the first and second spool halves from rotating axially relative to each other.

26. The spool of claim 25 wherein each of the first and second spool halves includes means for independently securing the one of the first and second spool halves to the drive shaft.

27. The spool of claim 25 wherein the hub opening of each of the first and second spool halves is defined in part by a first arcuate inner sidewall and a second inner sidewall where the second inner sidewall has a radius greater than the radius of the first inner wall.

28. The spool of claim 27 wherein the barrel sleeve distal end of each of the first and second spool halves seats against the second inner sidewall of the hub of the other of the first and second spool halves when the first and second spool halves are mated together.

* * * * *